US012196203B2

(12) United States Patent
Katou et al.

(10) Patent No.: US 12,196,203 B2
(45) Date of Patent: Jan. 14, 2025

(54) SCROLL COMPRESSOR AND REFRIGERATION DEVICE

(71) Applicant: DAIKIN INDUSTRIES, LTD., Osaka (JP)

(72) Inventors: Katsumi Katou, Osaka (JP); Yasuhiro Murakami, Osaka (JP); Kazuhiko Matsukawa, Osaka (JP); Akira Mori, Osaka (JP); Eitarou Nakatani, Osaka (JP); Yuuki Matsumoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/584,759

(22) Filed: Feb. 22, 2024

(65) Prior Publication Data

US 2024/0191712 A1 Jun. 13, 2024

Related U.S. Application Data

(63) Continuation of application No. PCT/JP2022/024388, filed on Jun. 17, 2022.

(30) Foreign Application Priority Data

Aug. 24, 2021 (JP) ..... 2021-136096
Aug. 24, 2021 (JP) ..... 2021-136097

(51) Int. Cl.
*F04C 18/02* (2006.01)
*F04C 29/02* (2006.01)
*F25B 31/02* (2006.01)

(52) U.S. Cl.
CPC ..... *F04C 18/0253* (2013.01); *F04C 29/028* (2013.01); *F25B 31/026* (2013.01)

(58) Field of Classification Search
CPC .. F04C 18/0215; F04C 18/0253; F04C 29/02; F04C 29/028
See application file for complete search history.

(56) References Cited

U.S. PATENT DOCUMENTS

2014/0010694 A1 1/2014 Tsuka et al.
2015/0147214 A1* 5/2015 Nagahara ..... F04C 29/028 418/55.2

(Continued)

FOREIGN PATENT DOCUMENTS

EP 2 690 287 A1 1/2014
EP 3 933 202 A1 1/2022

(Continued)

OTHER PUBLICATIONS

International Preliminary Report of corresponding PCT Application No. PCT/JP2022/024388 dated Mar. 7, 2024.

(Continued)

*Primary Examiner* — Mark A Laurenzi
*Assistant Examiner* — Xiaoting Hu
(74) *Attorney, Agent, or Firm* — Global IP Counselors, LLP

(57) ABSTRACT

A scroll compressor includes a fixed scroll and a movable scroll. A facing surface of the fixed scroll that faces the movable scroll has a fixed oil groove. The fixed oil groove has a fixed circumferential groove portion. The fixed circumferential groove portion has a circular-arc portion that extends in the circumferential direction, and a wide portion wider in a radial direction than a groove width of the circular-arc portion. A facing surface of the movable scroll that faces the fixed scroll has a movable oil groove. The movable oil groove has a movable circumferential groove portion, and a radial groove portion that communicates with the movable circumferential groove portion. In a predetermined region of an angle range where the movable scroll makes an orbiting motion, a portion of the radial groove portion overlaps the wide portion as viewed from an axial direction.

6 Claims, 8 Drawing Sheets

(56) References Cited

U.S. PATENT DOCUMENTS

| | | | | |
|---|---|---|---|---|
| 2016/0377081 | A1* | 12/2016 | Cho | F04C 23/008 418/55.1 |
| 2018/0051697 | A1* | 2/2018 | Murakami | F04C 29/028 |
| 2021/0025395 | A1 | 1/2021 | Nagahara | |
| 2022/0178373 | A1 | 6/2022 | Tsuka | |
| 2022/0275802 | A1 | 9/2022 | Nakatani et al. | |

FOREIGN PATENT DOCUMENTS

| | | | |
|---|---|---|---|
| JP | 2012-202221 | A | 10/2012 |
| JP | 5208528 | B2 | 6/2013 |
| JP | 2013-256919 | A | 12/2013 |
| JP | 2016-160816 | A | 9/2016 |
| JP | 2019-196708 | A | 11/2019 |
| JP | 2020-139460 | A | 9/2020 |
| JP | 2021-42749 | A | 3/2021 |
| JP | 2021-80904 | A | 5/2021 |

OTHER PUBLICATIONS

International Search Report of corresponding PCT Application No. PCT/JP2022/024388 dated Aug. 2, 2022.
European Search Report of corresponding EP Application No. 22 86 0945.9 dated Oct. 8, 2024.

* cited by examiner

<FIRST STATE>

<SECOND STATE>

<THIRD STATE>

<FOURTH STATE>

SCROLL COMPRESSOR AND REFRIGERATION DEVICE

CROSS-REFERENCE TO RELATED APPLICATIONS

This is a continuation of International Application No. PCT/JP2022/024388 filed on Jun. 17, 2022, which claims priority to Japanese Patent Application No. 2021-136096, filed on Aug. 24, 2021, and Japanese Patent Application No. 2021-136097, filed on Aug. 24, 2021. The entire disclosures of these applications are incorporated by reference herein.

BACKGROUND

Technical Field

The present disclosure relates to a scroll compressor and a refrigeration apparatus.

Background Art

Japanese Unexamined Patent Publication No. 2012-202221 discloses a scroll compressor including: a fixed scroll that has an outer circumferential wall having an end portion with a fixed oil groove; and a movable scroll that includes an end plate with a movable oil groove.

In the scroll compressor of Japanese Unexamined Patent Publication No. 2012-202221, a high-pressure lubricant is supplied to the fixed oil groove. An orbiting motion of the movable scroll causes the movable oil groove to communicate with the fixed oil groove. Thus, the lubricant in the fixed oil groove is supplied to the movable oil groove. This lubricant is used to lubricate the facing surfaces (thrust surfaces) of the outer circumferential wall of the fixed scroll and the end plate of the movable scroll.

SUMMARY

An aspect of the present disclosure is directed to a scroll compressor including a fixed scroll and a movable scroll. A facing surface of the fixed scroll faces the movable scroll. The facing surface of the fixed scroll has a fixed oil groove. The fixed oil groove has a fixed circumferential groove portion that extends in a circumferential direction. The fixed circumferential groove portion has a circular-arc portion that extends in the circumferential direction, and a wide portion wider in a radial direction than a groove width of the circular-arc portion. A facing surface of the movable scroll faces the fixed scroll. The facing surface of the movable scroll has a movable oil groove. The movable oil groove has a movable circumferential groove portion that extends in the circumferential direction, and a radial groove portion that extends in the radial direction and communicates with the movable circumferential groove portion. In a predetermined region of an angle range where the movable scroll makes an orbiting motion, a portion of the radial groove portion overlaps the wide portion as viewed from an axial direction.

DETAILED DESCRIPTION OF EMBODIMENT(S)

Figure 1:
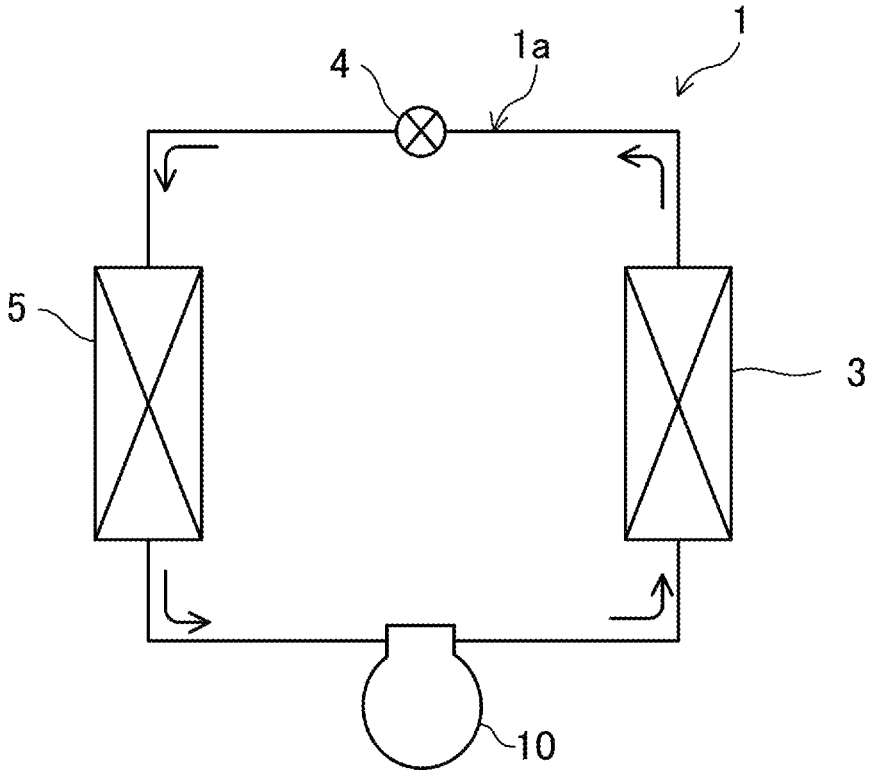
FIG. 1 is a refrigerant circuit diagram showing a configuration of a refrigeration apparatus according to this embodiment.

As illustrated in FIG. 1, a scroll compressor (10) is provided in a refrigeration apparatus (1). The refrigeration apparatus (1) includes a refrigerant circuit (1*a*) filled with a refrigerant. The refrigerant circuit (1*a*) includes the scroll compressor (10), a radiator (3), a decompression mechanism (4), and an evaporator (5). The decompression mechanism (4) is, for example, an expansion valve. The refrigerant circuit (1*a*) performs a vapor compression refrigeration cycle.

The refrigeration apparatus (1) is an air conditioner. The air conditioner may be any of a cooling-only apparatus, a heating-only apparatus, or an air conditioner switchable between cooling and heating. In this case, the air conditioner has a switching mechanism (e.g., a four-way switching valve) configured to switch the direction of circulation of the refrigerant. The refrigeration apparatus (1) may be a water heater, a chiller unit, or a cooling apparatus configured to cool air in an internal space. The cooling apparatus cools air inside, e.g., a refrigerator, a freezer, or a container.

Figure 2:
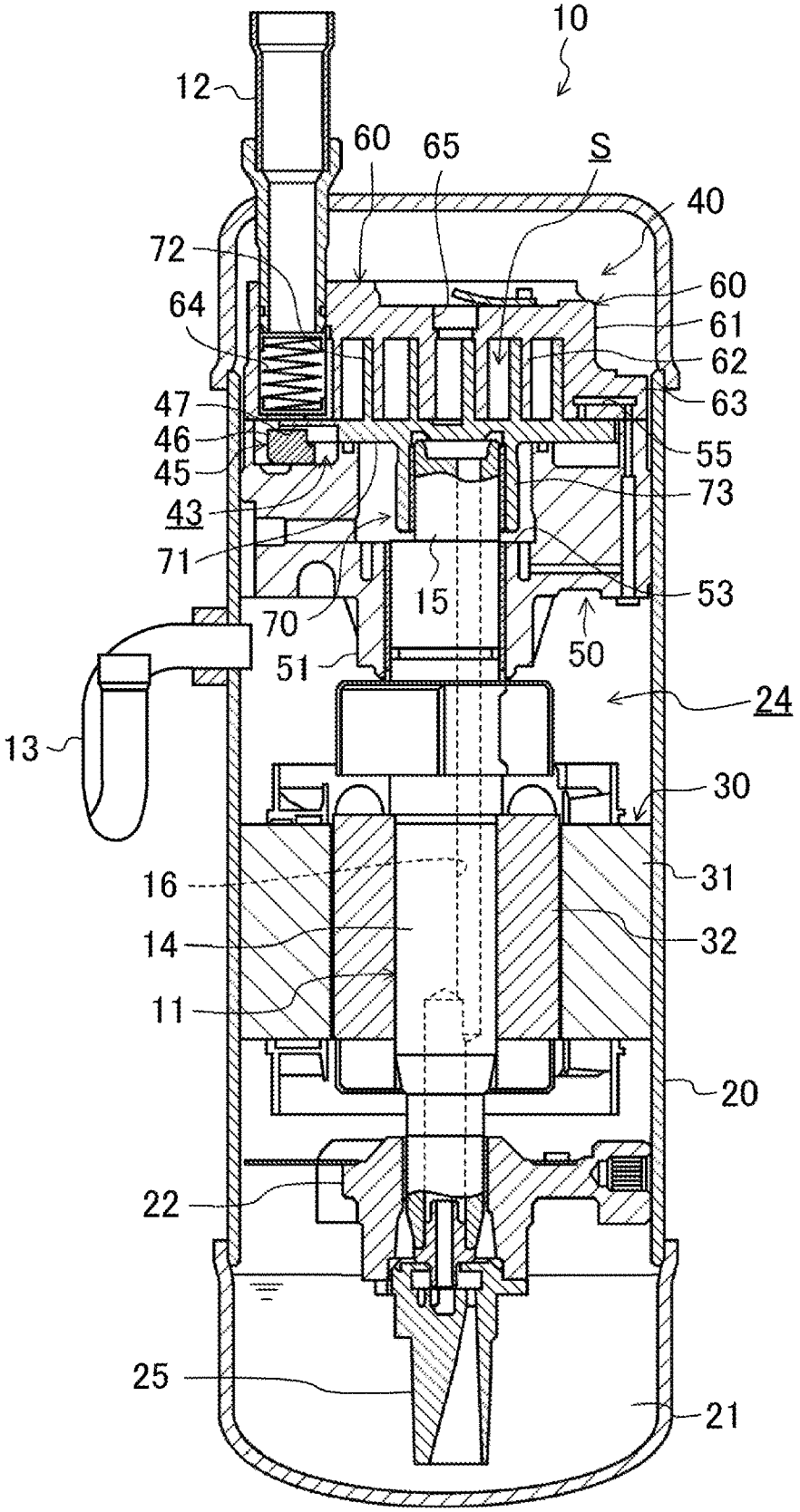
FIG. 2 is a vertical sectional view illustrating a configuration of a scroll compressor.

As illustrated in FIG. 2, the scroll compressor (10) includes a casing (20), an electric motor (30), and a compression mechanism (40). The casing (20) has a vertically oriented cylindrical shape, and is configured as a closed dome. The casing (20) houses the electric motor (30) and the compression mechanism (40).

The electric motor (30) includes a stator (31) and a rotor (32). The stator (31) is fixed to the inner circumferential surface of the casing (20). The rotor (32) is disposed inside the stator (31). A drive shaft (11) passes through the rotor (32). The rotor (32) is fixed to the drive shaft (11).

The casing (20) has, at its bottom, an oil reservoir (21). The oil reservoir (21) stores a lubricant. A suction pipe (12) is connected to an upper portion of the casing (20). A discharge pipe (13) is connected to a barrel of the casing (20).

A housing (50) is fixed to the casing (20). The housing (50) is fixed to the inside of the casing (20) by, for example, shrink fitting. The housing (50) is located above the electric motor (30). The compression mechanism (40) is located above the housing (50). The discharge pipe (13) has an inflow end between the electric motor (30) and the housing (50).

The housing (50) has a recess (53). The recess (53) is a recessed portion of the upper surface of the housing (50). An upper bearing (51) is located below the recess (53).

The drive shaft (11) extends vertically along the center axis of the casing (20). The drive shaft (11) has a main shaft portion (14) and an eccentric portion (15).

The eccentric portion (15) is provided at an upper end of the main shaft portion (14). The main shaft portion (14) has a lower portion rotatably supported by a lower bearing (22). The lower bearing (22) is fixed to the inner circumferential surface of the casing (20). The lower bearing (22) is provided with a positive-displacement pump (25), for example. The main shaft portion (14) has an upper portion passing through the housing (50) and rotatably supported by the upper bearing (51) of the housing (50).

The compression mechanism (40) includes a fixed scroll (60) and a movable scroll (70). The fixed scroll (60) is fixed to the upper surface of the housing (50). The movable scroll (70) is arranged between the fixed scroll (60) and the housing (50).

The fixed scroll (60) includes a fixed end plate (61), a fixed wrap (62), and an outer circumferential wall (63). The outer circumferential wall (63) is substantially tubular. The outer circumferential wall (63) is erected at the outer edge of the front surface (the lower surface in FIG. 2) of the fixed end plate (61).

The fixed wrap (62) is spiral. The fixed wrap (62) is erected on a portion of the fixed end plate (61) inside the outer circumferential wall (63).

The fixed end plate (61) is located on the outer circumference and is continuous with the fixed wrap (62). The end surface of the fixed wrap (62) and the end surface of the outer circumferential wall (63) are substantially flush with each other. The fixed scroll (60) is fixed to the housing (50).

The movable scroll (70) includes a movable end plate (71), a movable wrap (72), and a boss (73). The movable wrap (72) is spiral. The movable wrap (72) is formed on the upper surface of the movable end plate (71). The movable wrap (72) meshes with the fixed wrap (62).

The boss (73) is formed on a central portion of the lower surface of the movable end plate (71). The eccentric portion (15) of the drive shaft (11) is inserted into the boss (73), whereby the boss (73) is connected to the drive shaft (11).

An Oldham coupling (45) is provided at an upper portion of the housing (50). The Oldham coupling (45) blocks the rotation of the movable scroll (70) on its axis. The Oldham coupling (45) is provided with a key (46). The key (46) protrudes toward the lower surface of the movable end plate (71) of the movable scroll (70). The lower surface of the movable end plate (71) of the movable scroll (70) has a keyway (47). The key (46) of the Oldham coupling (45) is slidably fitted to the keyway (47).

Although not shown, a key is provided in a portion of the Oldham coupling (45) toward the housing (50). The key toward the housing (50) is slidably fitted to a keyway (not shown) of the housing (50).

The compression mechanism (40) has a fluid chamber (S) into which the refrigerant flows. The fluid chamber (S) is formed between the fixed scroll (60) and the movable scroll (70). The movable scroll (70) is placed so that the movable wrap (72) meshes with the fixed wrap (62) of the fixed scroll (60). Here, the lower surface of the outer circumferential wall (63) of the fixed scroll (60) serves as a facing surface that faces the movable scroll (70). On the other hand, the upper surface of the movable end plate (71) of the movable scroll (70) serves as a facing surface that faces the fixed scroll (60).

The outer circumferential wall (63) of the fixed scroll (60) has a suction port (64). The suction port (64) is open near the winding end of the fixed wrap (62). The suction port (64) is connected to a downstream end of the suction pipe (12).

The fixed end plate (61) of the fixed scroll (60) has, at its center, an outlet (65). The outlet (65) is open to the upper surface of the fixed end plate (61) of the fixed scroll (60). The high-pressure gas refrigerant discharged from the outlet (65) flows out into a lower space (24) via a passage (not shown) formed in the housing (50).

An oil supply passage (16) is formed inside the drive shaft (11). The oil supply passage (16) extends vertically from the lower end to the upper end of the drive shaft (11). The pump (25) is connected to the lower end of the drive shaft (11). A lower end portion of the pump (25) is immersed in the oil reservoir (21). The pump (25) sucks up the lubricant from the oil reservoir (21) as the drive shaft (11) rotates, and transfers the lubricant to the oil supply passage (16). The oil supply passage (16) supplies the lubricant in the oil reservoir (21) to the sliding surfaces between the lower bearing (22) and the drive shaft (11) and the sliding surfaces between the upper bearing (51) and the drive shaft (11), and to the sliding surfaces between the boss (73) and the drive shaft (11). The oil supply passage (16) is open to the upper end surface of the drive shaft (11) and supplies the lubricant to above the drive shaft (11).

The recess (53) of the housing (50) communicates with the oil supply passage (16) of the drive shaft (11) via the inside of the boss (73) of the movable scroll (70). The high-pressure lubricant is supplied to the recess (53), so that a high pressure equivalent to the discharge pressure of the compression mechanism (40) acts on the recess (53). The movable scroll (70) is pressed onto the fixed scroll (60) by the high pressure that acts on the recess (53) and an intermediate pressure that acts on an intermediate-pressure portion (43), which will be described later.

An oil path (55) is provided in the housing (50) and the fixed scroll (60). The oil path (55) has an inflow end that communicates with the recess (53) of the housing (50). The oil path (55) has an outflow end open to the facing surface of the fixed scroll (60). Through the oil path (55), the high-pressure lubricant in the recess (53) is supplied to the facing surfaces of the movable end plate (71) of the movable scroll (70) and the outer circumferential wall (63) of the fixed scroll (60).

Figure 5:
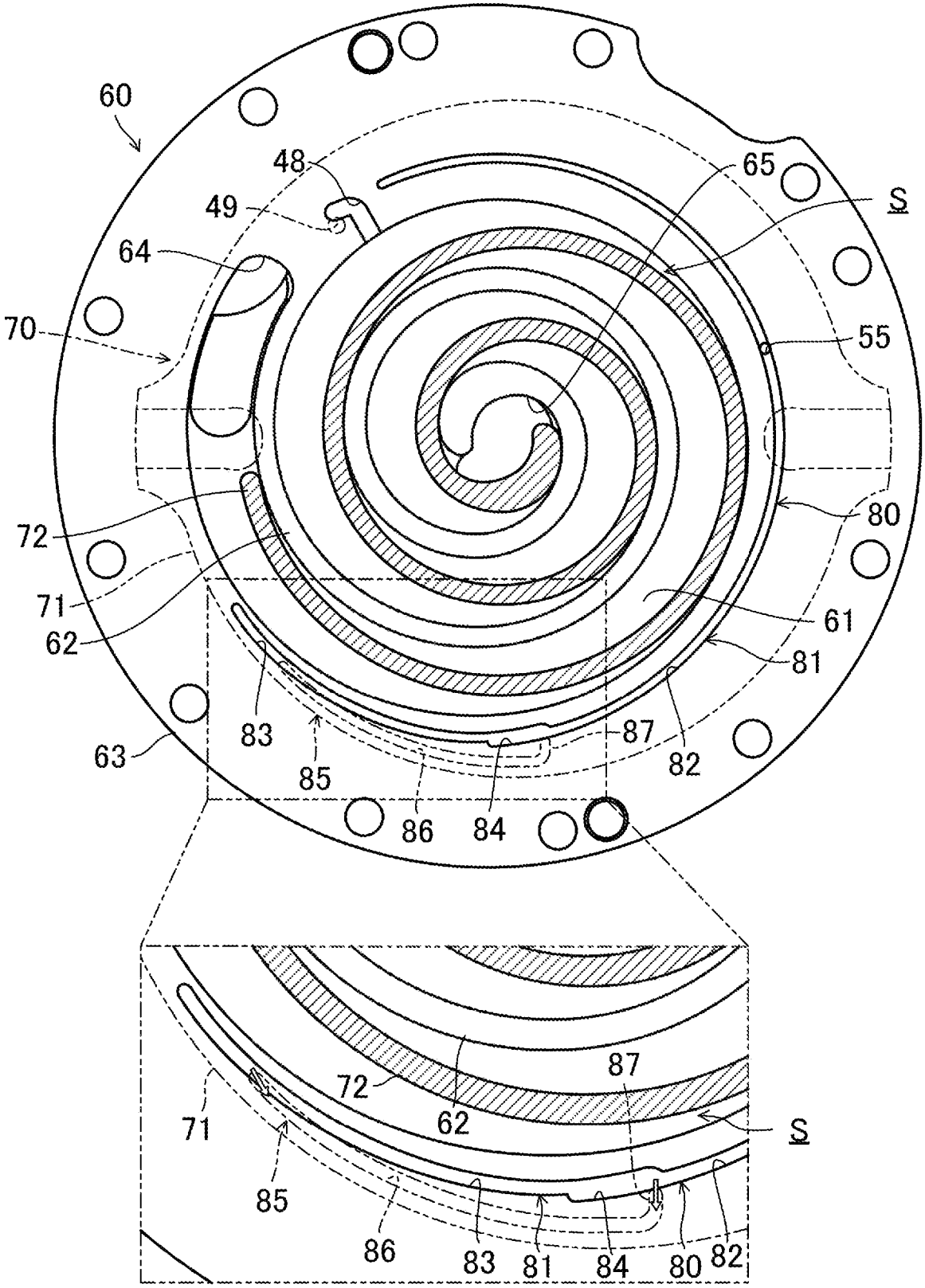
FIG. 5 is a diagram illustrating a positional relationship between a fixed oil groove and a movable oil groove in a first state.

The lower surface of the outer circumferential wall (63) of the fixed scroll (60) has a primary path (48) (see FIG. 5). The inner end of the primary path (48) is open to the inner circumferential surface of the outer circumferential wall (63), and communicates with the fluid chamber (S) at intermediate pressure.

An outer circumferential portion of the movable end plate (71) of the movable scroll (70) has a secondary path (49) (see FIG. 5). The secondary path (49) is configured as a through hole passing vertically through the movable end plate (71). The secondary path (49) has an upper end that intermittently communicates with the outer end of the primary path (48), and a lower end that communicates with the intermediate-pressure portion (43) between the movable scroll (70) and the housing (50). That is to say, the intermediate-pressure refrigerant is intermittently supplied from the fluid chamber (S) at intermediate pressure to the intermediate-pressure portion (43). The intermediate-pressure portion (43) therefore has a predetermined intermediate pressure.

Configurations of Fixed Oil Groove and Movable Oil Groove

Figure 3:
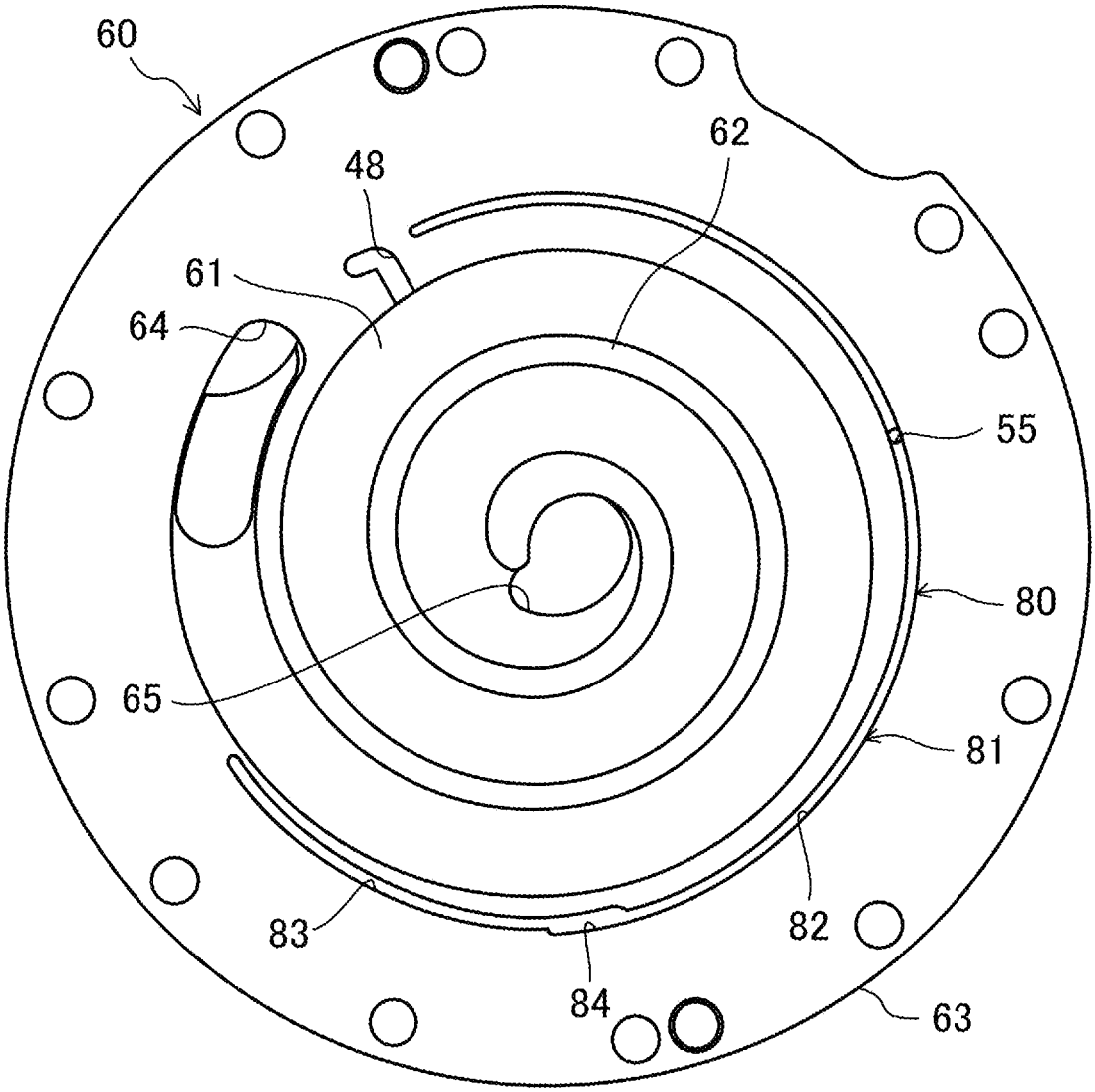
FIG. 3 is a diagram illustrating a bottom view of a configuration of a fixed scroll.

As illustrated in FIG. 3, a fixed oil groove (80) is formed in the facing surface (the lower surface in FIG. 2), of the outer circumferential wall (63) of the fixed scroll (60), which faces the movable end plate (71) of the movable scroll (70).

The fixed oil groove (80) has a fixed circumferential groove portion (81). The fixed circumferential groove portion (81) extends in a circumferential direction along the inner circumferential surface of the outer circumferential wall (63) of the fixed scroll (60). The oil path (55) communicates with the fixed circumferential groove portion (81), and the lubricant is supplied to the fixed circumferential groove portion (81) from the oil path (55).

The fixed circumferential groove portion (81) has a first circular-arc portion (82), a second circular-arc portion (83), and a wide portion (84). A first end portion of the first circular-arc portion (82) near the second circular-arc portion (83) (the end portion in the clockwise direction in FIG. 3) and a second end portion of the second circular-arc portion (83) near the first circular-arc portion (82) (the end portion in the counterclockwise direction in FIG. 3) are arranged side by side in the radial direction, and are partially overlapped and connected together. The wide portion (84) is provided at the portion where the first end portion of the first circular-arc portion (82) and the second end portion of the second circular-arc portion (83) are connected together. The wide portion (84) is wider in the radial direction than the groove width of each of the first circular-arc portion (82) and the second circular-arc portion (83).

Figure 4:
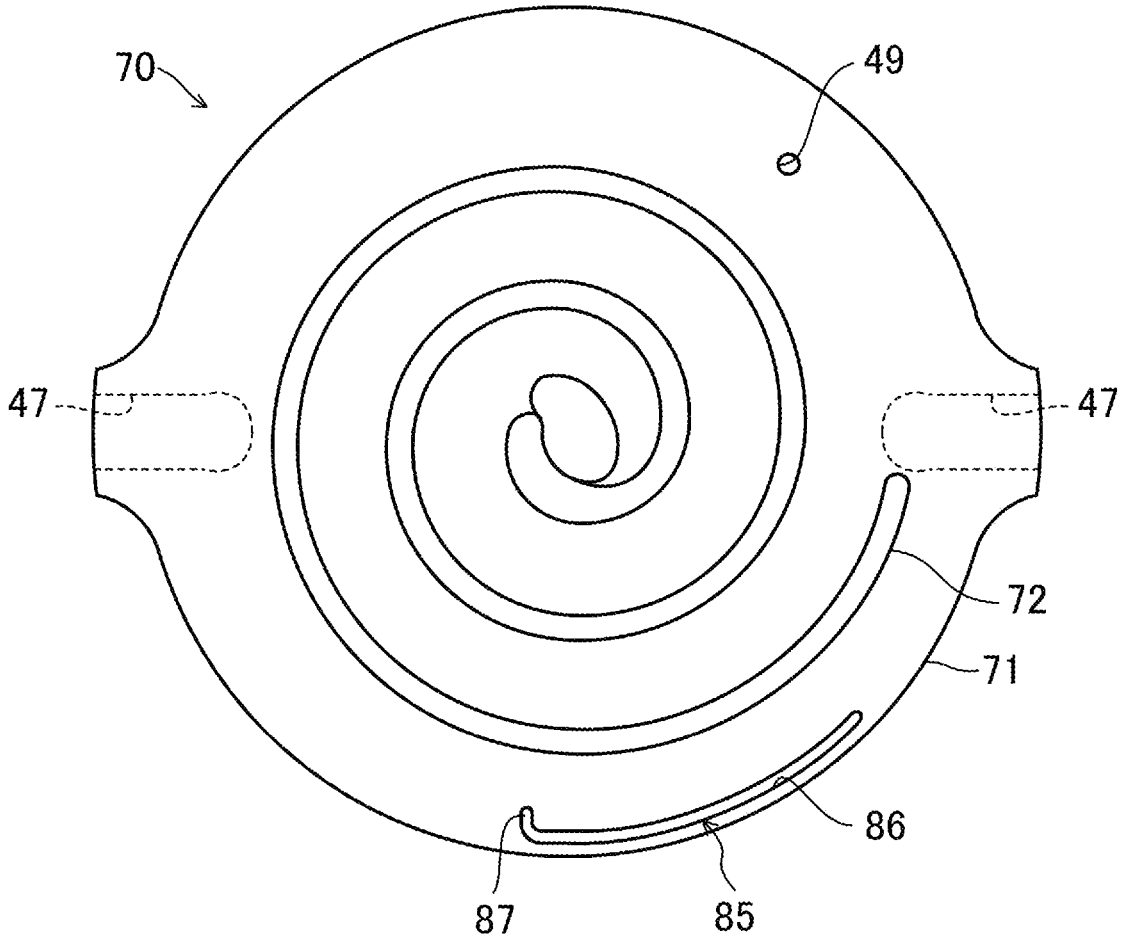
FIG. 4 is a diagram illustrating a plan view of a configuration of a movable scroll.

As illustrated in FIG. 4, the facing surface of the movable scroll (70) which faces the fixed scroll (60) has a movable oil groove (85). The movable oil groove (85) has a movable circumferential groove portion (86) and a radial groove portion (87). The movable circumferential groove portion (86) extends in the circumferential direction along the outer circumferential surface of the movable wrap (72). The radial groove portion (87) extends radially to communicate with one end portion of the movable circumferential groove portion (86) (the end portion in the clockwise direction in FIG. 4).

The radial groove portion (87) is bent from the one end portion of the movable circumferential groove portion (86) and extends toward the center of the movable scroll (70). That is to say, the radial groove portion (87) extends radially inward on the movable end plate (71) of the movable scroll (70), and has an inner end portion that can communicate with the fluid chamber (S).

As illustrated in FIG. 5, in a predetermined region of the angle range where the movable scroll (70) makes an orbiting motion, a portion of the radial groove portion (87) overlaps the wide portion (84) as viewed from the axial direction. An end portion of the fixed oil groove (80) toward the winding end of the fixed wrap (62) is closer to the suction port (64) than an end portion of the movable circumferential groove portion (86) of the movable oil groove (85) toward the winding end of the movable wrap (72) is.

This can increase the length of the fixed oil groove (80) that communicates with the oil path (55) all the time, thereby making it possible to enlarge the area to which the lubricant is supplied. As a result, the high-pressure regions of the facing surfaces of the fixed scroll (60) and the movable scroll (70) can be enlarged. Thus, an oil film can be adequately formed between the fixed scroll (60) and the movable scroll (70).

Operation

A basic operation of the scroll compressor (10) will be described. In FIG. 2, when the electric motor (30) is activated, the drive shaft (11) to which the rotor (32) is fixed is driven to rotate. Since the rotation of the movable scroll (70) on its own axis is blocked by the Oldham coupling (45), the movable scroll (70) makes an orbiting motion about the axis of the drive shaft (11).

The orbiting motion of the movable scroll (70) causes the refrigerant to be compressed in the fluid chamber (S). The high-pressure gas refrigerant compressed in the fluid chamber (S) is discharged from the outlet (65), and flows out into the lower space (24) via the passage (not shown) formed in the housing (50). The high-pressure gas refrigerant in the lower space (24) is discharged outside the casing (20) via the discharge pipe (13).

The rotation of the drive shaft (11) causes the high-pressure lubricant in the oil reservoir (21) to be sucked up by the pump (25). The lubricant sucked up flows upward through the oil supply passage (16) of the drive shaft (11) and flows out from the opening at the upper end of the eccentric portion (15) of the drive shaft (11) into the inside of the boss (73) of the movable scroll (70).

The lubricant supplied to the boss (73) flows out into the recess (53) of the housing (50) through the gap between the eccentric portion (15) of the drive shaft (11) and the boss (73). Accordingly, the recess (53) of the housing (50) has a high pressure equivalent to the discharge pressure of the compression mechanism (40). The movable scroll (70) is pressed onto the fixed scroll (60) by the high pressure that acts on the recess (53) and the intermediate pressure that acts on the intermediate-pressure portion (43).

The high-pressure lubricant accumulated in the recess (53) flows out through the oil path (55) into the fixed oil groove (80). Accordingly, the lubricant with the high pressure equivalent to the discharge pressure of the compression mechanism (40) is supplied to the fixed oil groove (80).

The compression mechanism (40) has four states in which the high-pressure lubricant in the fixed oil groove (80) is supplied to respective predetermined portions. Specifically, the state of the compression mechanism (40) changes sequentially, e.g., first state, second state, third state, fourth state, first state, second state, . . . , during the orbiting motion of the movable scroll (70).

First State

The first state is when the movable scroll (70) is located, for example, at the eccentric angle position shown in FIG. 5. In the first state, the wide portion (84) of the fixed oil groove (80) and one end portion (a radially inner end portion) of the radial groove portion (87) of the movable oil groove (85) communicate with each other. In the first state, the fixed circumferential groove portion (81) of the fixed circumferential groove portion (81) of the fixed oil groove (80) overlaps, and communicates with, an end portion (the end portion in the clockwise direction in FIG. 5) of the movable circumferential groove portion (86) of the movable oil groove (85).

Thus, the high-pressure lubricant flowing through the fixed oil groove (80) flows into the movable oil groove (85) from the end portions of the radial groove portion (87) and the movable circumferential groove portion (86). As a result, the radial groove portion (87) and the movable circumferential groove portion (86) of the movable oil groove (85) are filled with the high-pressure lubricant. In the first state, the movable oil groove (85) and the fluid chamber (S) are isolated from each other. For this reason, the high-pressure lubricant in the movable oil groove (85) is used to lubricate the facing surfaces around the movable oil groove (85).

Second State

Figure 6:
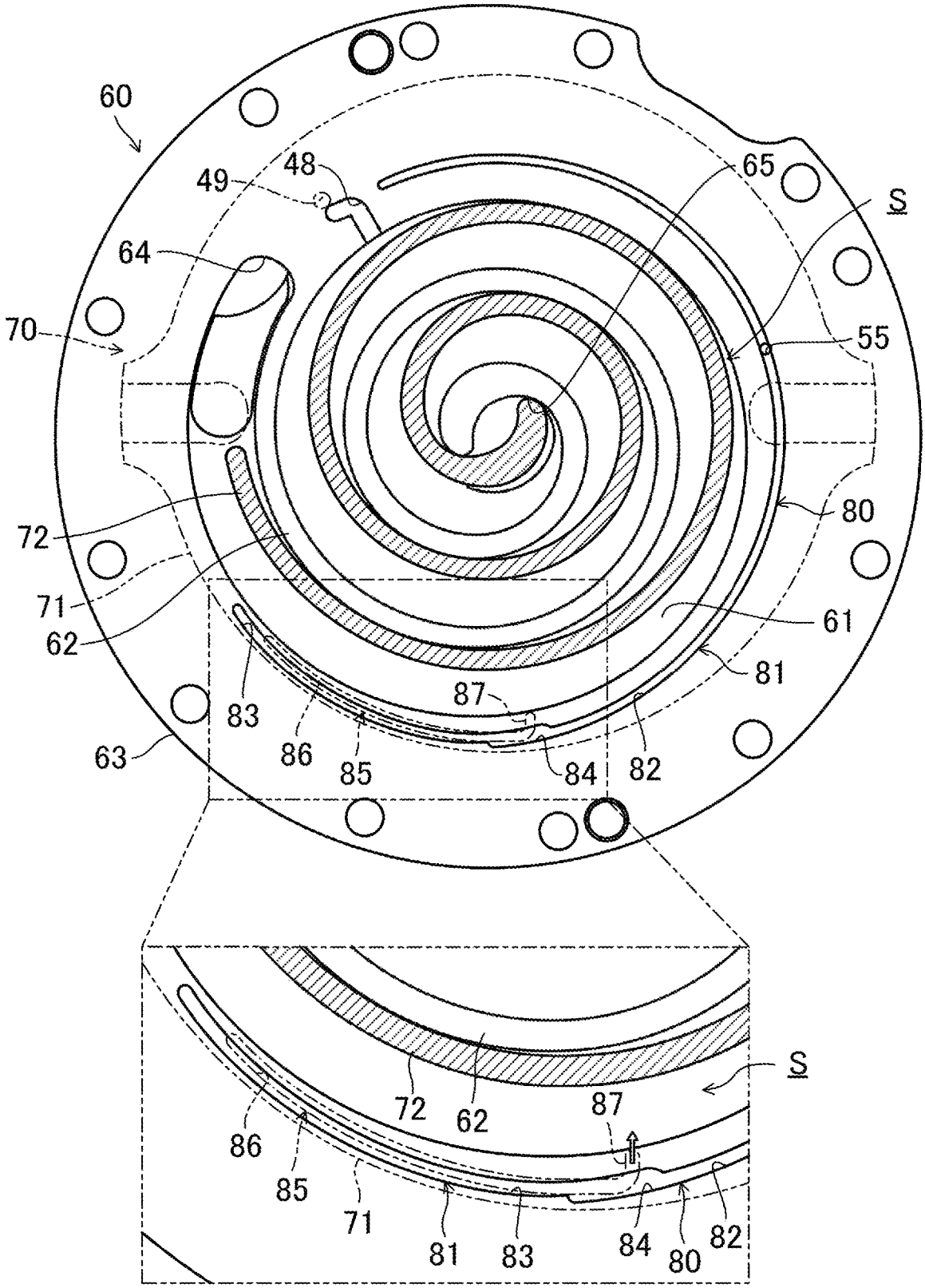
FIG. 6 is a diagram illustrating a positional relationship between the fixed oil groove and the movable oil groove in a second state.

The second state is when the movable scroll (70) at the eccentric angle position in FIG. 5 further makes an orbiting motion and is located at the eccentric angle position shown in FIG. 6, for example. In the second state, the wide portion (84) of the fixed oil groove (80) and the radial groove portion (87) of the movable oil groove (85) communicate with each other. The fixed circumferential groove portion (81) of the fixed oil groove (80) overlaps, and communicates with, the movable circumferential groove portion (86) of the movable oil groove (85). This enables smooth transfer of the lubricant from the fixed oil groove (80) to the movable oil groove (85). Further at the same time, in the second state, the one end portion of the radial groove portion (87) of the movable oil groove (85) communicates with the fluid chamber (S).

In the second state, the movable oil groove (85) communicates with both of the fluid chamber (S) and the fixed oil groove (80). Thus, in the second state, the fixed oil groove (80) communicates with the fluid chamber (S) via the radial groove portion (87), and the high-pressure lubricant flowing through the movable oil groove (85) and the fixed oil groove (80) can be adequately supplied to the fluid chamber (S).

In addition, since the radial groove portion (87) of the movable oil groove (85) communicates with the fluid chamber (S) connected to the suction port (64), the difference between the pressure of the lubricant in the movable oil groove (85) and the fixed oil groove (80) and the pressure of the refrigerant in the fluid chamber (S) increases, making it possible to supply a sufficient amount of the lubricant to the fluid chamber (S).

Third State

Figure 7:
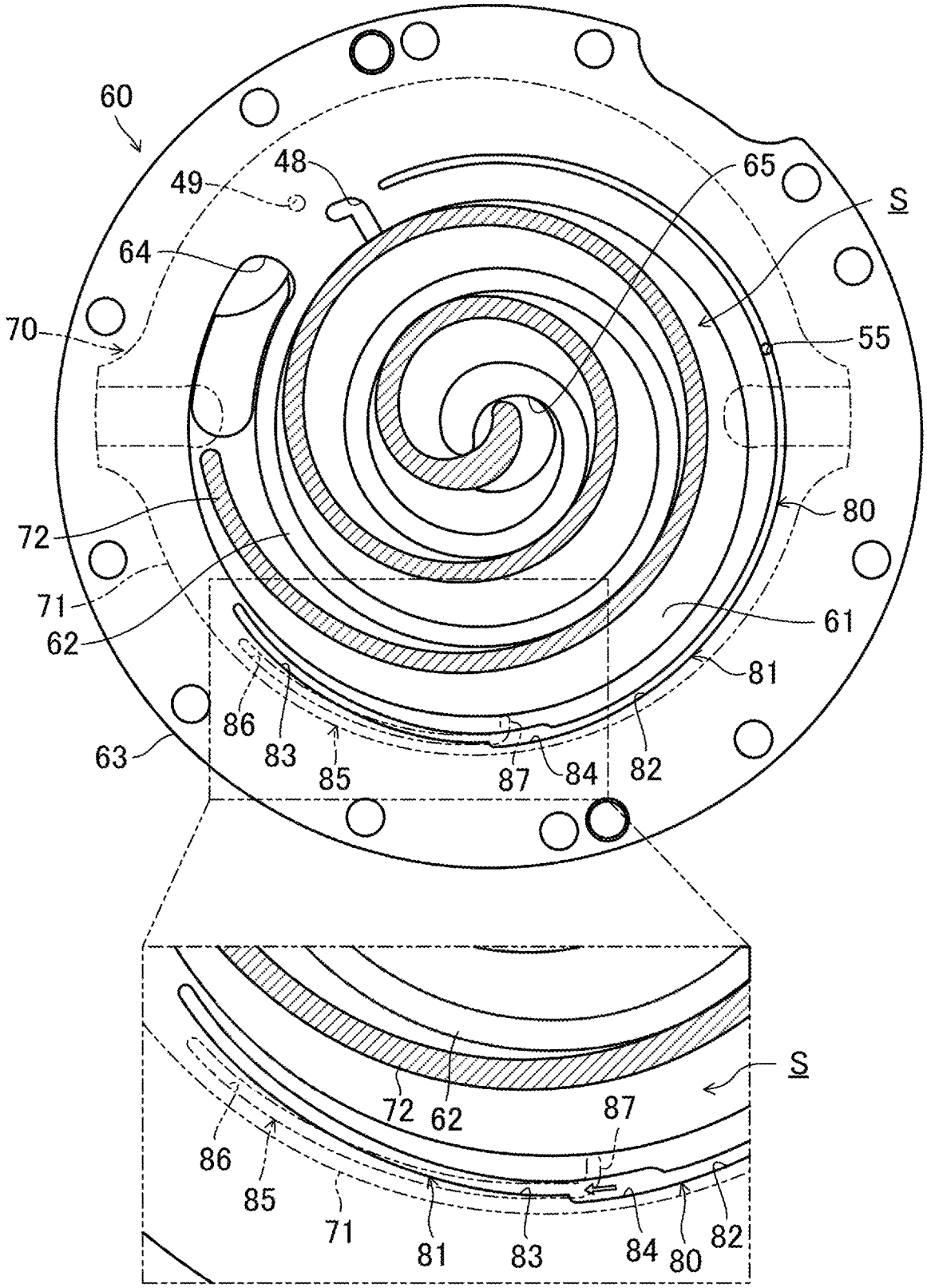
FIG. 7 is a diagram illustrating a positional relationship between the fixed oil groove and the movable oil groove in a third state.

The third state is when the movable scroll (70) at the eccentric angle position in FIG. 6 further makes an orbiting motion and is located at the eccentric angle position shown in FIG. 7, for example. In the third state, the radial groove portion (87) of the movable oil groove (85) and the fluid chamber (S) are isolated from each other. However, in the third state, the movable oil groove (85) and the fixed oil groove (80) still communicate with each other even after the second state.

The interior of the movable oil groove (85) is kept at high pressure while the movable oil groove (85) and the fixed oil groove (80) are kept communicating with each other. It is thus possible to supply the lubricant in the movable oil groove (85) to the facing surfaces around the movable oil groove (85) in the third state as well.

The lubricant is therefore supplied from both of the fixed oil groove (80) and the movable oil groove (85) to the portions around the end portion of the fixed oil groove (80) on the facing surfaces of the fixed scroll (60) and the movable scroll (70), thereby making it possible to increase the amount of supply of the lubricant.

Fourth State

Figure 8:
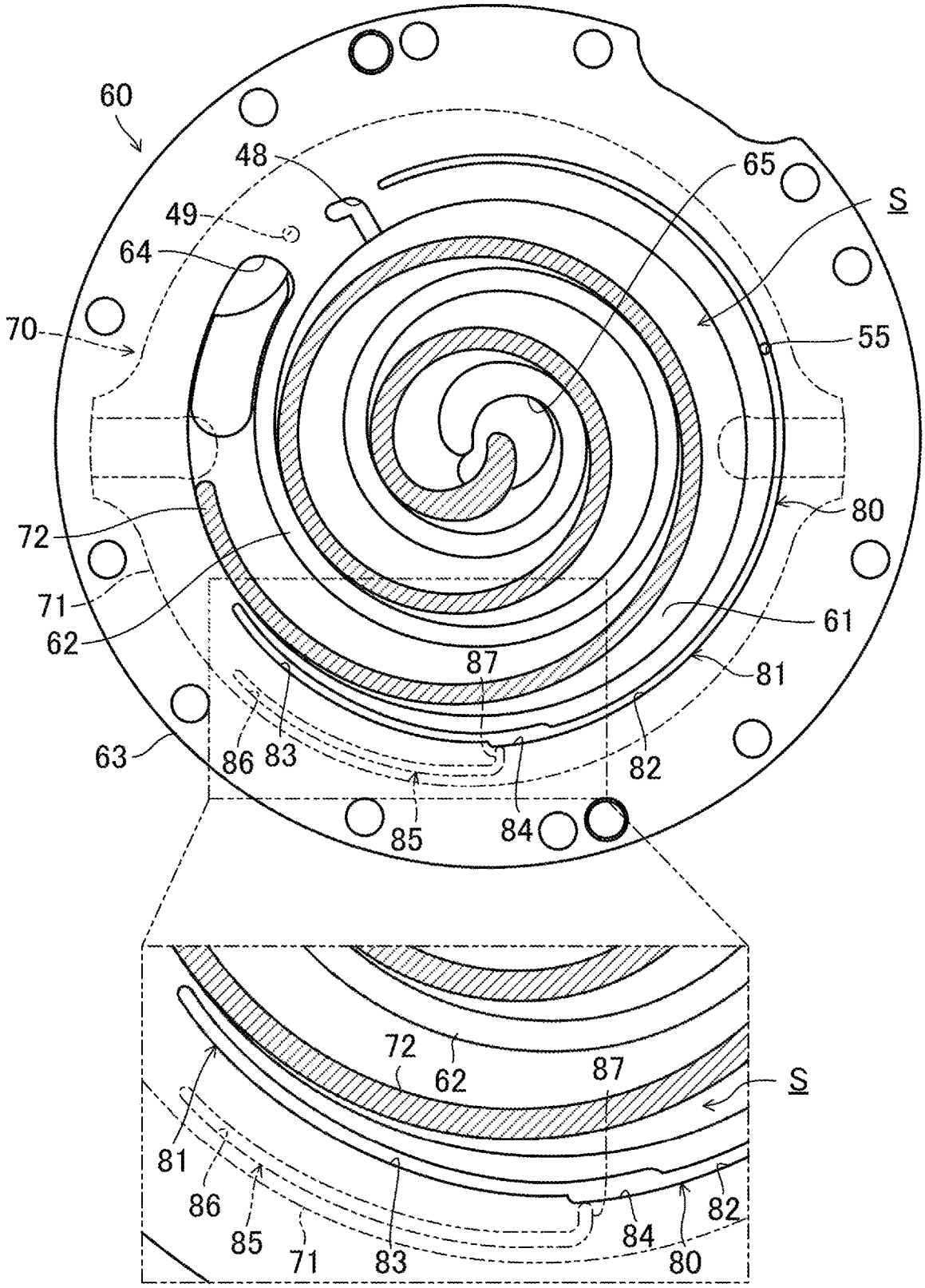
FIG. 8 is a diagram illustrating a positional relationship between the fixed oil groove and the movable oil groove in a fourth state.

The fourth state is when the movable scroll (70) at the eccentric angle position in FIG. 7 further makes an orbiting motion and is located at the eccentric angle position shown in FIG. 8, for example. In the fourth state, the movable oil groove (85) is isolated from both of the fluid chamber (S) and the fixed oil groove (80). Thus, the supply of the high-pressure lubricant from the fixed oil groove (80) to the movable oil groove (85) is interrupted.

Specifically, in the compression mechanism (40), the supply of the lubricant from the fixed oil groove (80) to the fluid chamber (S) is intermittently interrupted during a 360° orbiting motion of the movable scroll (70). This can prevent the lubricant from being excessively supplied from the fixed oil groove (80) to the fluid chamber (S) in a continuous manner.

After the fourth state, the state changes to the first state again, and thereafter, to the second state, the third state, and the fourth state sequentially.

Advantages of Embodiment

According to a feature of this embodiment, the fixed oil groove (80) is provided on the facing surface of the fixed scroll (60) which faces the movable scroll (70). The fixed oil groove (80) has the fixed circumferential groove portion (81). The wide portion (84) is wider in the radial direction than the groove width of the circular-arc portion of the fixed circumferential groove portion (81). The movable oil groove (85) is provided on the facing surface of the movable scroll (70) which faces the fixed scroll (60). In the predetermined region of the angle range where the movable scroll (70) makes the orbiting motion, a portion of the radial groove portion (87) of the movable oil groove (85) overlaps the wide portion (84) as viewed from the axial direction.

Transferring the lubricant through the wide portion (84) as described above can enlarge the angle range where the fixed oil groove (80) and the movable oil groove (85) communicate with each other, thereby making it possible to increase the supply amount of the lubricant to the facing surfaces of the fixed scroll (60) and the movable scroll (70).

In a predetermined region of the angle range where the movable scroll (70) makes the orbiting motion, the fixed oil groove (80) and the movable oil groove (85) start communicating with each other. Here, one of the movable circumferential groove portion (86) or the radial groove portion (87) of the movable oil groove (85) may start communicating with the fixed oil groove (80) earlier than the other.

According to a feature of this embodiment, the wide portion (84) is provided at the portion where the first circular-arc portion (82) and the second circular-arc portion (83) are connected together, and the lubricant is transferred through the wide portion (84). This configuration makes it easier to distribute the lubricant to the fixed oil groove (80) and the movable oil groove (85).

According to a feature of this embodiment, the first circular-arc portion (82) and the second circular-arc portion (83) are displaced from each other in the radial direction and connected together at their ends. It is thus possible to form the wide portion (84) at the connected portion.

According to a feature of this embodiment, the angle range where the fixed oil groove (80) and the movable oil groove (85) communicate with each other can be enlarged.

According to a feature of this embodiment, the fixed oil groove (80) is provided on the facing surface of the fixed scroll (60) which faces the movable scroll (70). The movable oil groove (85) is provided on the facing surface of the movable scroll (70) which faces the fixed scroll (60). The end portion of the fixed oil groove (80) toward the winding end of the fixed wrap (62) is closer to the suction port (64) than the end portion of the movable circumferential groove portion (86) of the movable oil groove (85) toward the winding end of the movable wrap (72) is.

In a predetermined region of the angle range where the movable scroll (70) makes the orbiting motion, the fixed oil groove (80) and the movable oil groove (85) start communicating with each other. Here, one of the movable circumferential groove portion (86) or the radial groove portion (87) of the movable oil groove (85) may start communicating with the fixed oil groove (80) earlier than the other.

The lubricant is therefore supplied from both of the fixed oil groove (80) and the movable oil groove (85) to the portions around the end portion of the fixed oil groove (80)

on the facing surfaces of the fixed scroll (60) and the movable scroll (70), thereby making it possible to increase the amount of supply of the lubricant.

According to a feature of this embodiment, the movable circumferential groove portion (86) of the movable oil groove (85) overlaps with the fixed oil groove (80) in the orbiting motion of the movable scroll (70). It is thus possible to transfer the lubricant smoothly from the fixed oil groove (80) to the movable oil groove (85).

According to a feature of this embodiment, a refrigeration apparatus includes the scroll compressor (10) and the refrigerant circuit (1*a*) through which the refrigerant compressed by the scroll compressor (10) flows. This can provide a refrigeration apparatus including the scroll compressor (10).

OTHER EMBODIMENTS

The embodiment described above may be modified as follows.

In this embodiment, the first end portion of the first circular-arc portion (82) of the fixed circumferential groove portion (81) and the second end portion of the second circular-arc portion (83) of the fixed circumferential groove portion (81) are arranged side by side in the radial direction, and are connected together while partially overlapped with each other to form the wide portion (84) at the portion where the first circular-arc portion (82) and the second circular-arc portion (83) are connected together. However, this form is merely an example.

For example, the wide portion (84) may be provided at an intermediate portion of one circular-arc portion extending in the circumferential direction. In this case, the wide portion (84) may be a portion wider in the radially outward direction than the circular-arc portion of the fixed circumferential groove portion (81). Accordingly, it is possible to enlarge the angle range where the radial groove portion (87) of the movable oil groove (85) communicates with the wide portion (84).

While the embodiment and variations have been described above, it will be understood that various changes in form and details can be made without departing from the spirit and scope of the claims. The above embodiment and variations may be appropriately combined or replaced as long as the functions of the target of the present disclosure are not impaired. In addition, the expressions of "first," "second," "third," . . . , in the specification and claims are used to distinguish the terms to which these expressions are given, and do not limit the number and order of the terms.

As described above, the present disclosure is useful for a scroll compressor.

The invention claimed is:

1. A scroll compressor comprising:

a fixed scroll; and a movable scroll, a facing surface of the fixed scroll facing the movable scroll, the facing surface of the fixed scroll having a fixed oil groove, and the fixed oil groove having a fixed circumferential groove portion that extends in a circumferential direction, the fixed circumferential groove portion having a first circular-arc portion that extends in the circumferential direction, a second circular-arc portion that extends in the circumferential direction, and a wide portion wider in a radial direction than groove widths of the first and second circular-arc portions, a first end portion of the first circular-arc portion adjacent the second circular-arc portion and a second end portion of the second circular-arc portion adjacent the first circular-arc portion being connected together, and the wide portion being provided at a portion where the first end portion of the first circular-arc portion and the second end portion of the second circular-arc portion are connected together, a facing surface of the movable scroll facing the fixed scroll, the facing surface of the movable scroll having a movable oil groove, and the movable oil groove having a movable circumferential groove portion that extends in the circumferential direction, and a radial groove portion that extends in the radial direction and communicates with the movable circumferential groove portion, and in a predetermined region of an angle range where the movable scroll makes an orbiting motion, a portion of the radial groove portion overlapping the wide portion as viewed from an axial direction.

2. The scroll compressor of claim 1, wherein the first end portion of the first circular-arc portion and the second end portion of the second circular-arc portion are arranged side by side in the radial direction and partially overlap each other.

3. The scroll compressor of claim 1, wherein the wide portion is wider in a radially outward direction than one of the first and second circular-arc portions of the fixed circumferential groove portion.

4. The scroll compressor of claim 1, wherein the fixed scroll includes a spiral fixed wrap and a suction port that is open adjacent a winding end of the fixed wrap, the movable scroll includes a spiral movable wrap, and an end portion of the fixed oil groove toward the winding end of the spiral fixed wrap is closer to the suction port than an end portion of the movable circumferential groove portion toward a winding end of the spiral movable wrap.

5. The scroll compressor of claim 4, wherein in the predetermined region of the angle range where the movable scroll makes the orbiting motion, a portion of the movable circumferential groove portion overlaps the fixed oil groove as viewed from the axial direction.

6. A refrigeration apparatus including the scroll compressor of claim 1, the refrigeration apparatus further comprising:

a refrigerant circuit through which a refrigerant compressed by the scroll compressor flows.

* * * * *